United States Patent [19]

Newkirk

[11] Patent Number: 4,460,486

[45] Date of Patent: Jul. 17, 1984

[54] POLYALKYLENE OXIDE LUBRICANTS OF IMPROVED OXIDATIVE STABILITY

[75] Inventor: David D. Newkirk, Beaverton, Oreg.

[73] Assignee: BASF Wyandotte Corporation, Wyandotte, Mich.

[21] Appl. No.: 438,398

[22] Filed: Nov. 1, 1982

[51] Int. Cl.[3] ..... D06M 13/18; C07C 1/20

[52] U.S. Cl. ..... 252/8.9; 252/52 A; 252/174.21; 427/389.9; 568/608; 568/609; 568/610

[58] Field of Search ..... 252/8.9, 174.21, 52 A; 427/389.9, 133, 393.5; 568/608, 609, 610

[56] References Cited

U.S. PATENT DOCUMENTS

| | | | |
|---|---|---|---|
| Re. 29,243 | 5/1977 | Umbach et al. | 252/174.21 X |
| 2,629,743 | 2/1953 | Burnette et al. | 252/174.21 |
| 4,094,797 | 6/1978 | Newkirk et al. | 252/8.9 |
| 4,134,841 | 1/1979 | Park et al. | 252/8.9 |
| 4,273,891 | 6/1981 | Pindar et al. | 252/52 A X |

*Primary Examiner*—Thurman K. Page

*Attorney, Agent, or Firm*—Bernhard R. Swick

[57] ABSTRACT

The process and polyoxyalkylene compound prepared by reacting 4,4'-thiodiphenol with at least one alkylene oxide in the presence of a base catalyst.

17 Claims, No Drawings

POLYALKYLENE OXIDE LUBRICANTS OF IMPROVED OXIDATIVE STABILITY

BACKGROUND OF THE INVENTION

1. Field of the Invention

This invention relates to polyalkylene oxide polymers and the use of these polymers as fiber and rubber lubricants. More particularly, this invention relates to polymers having an aromatic thio moiety incorporated into the polymers and of the use of these polymers as fiber and rubber lubricants having improved oxidative stability.

2. Description of the Prior Art

The conversion of nylon or polyester polymers into useful yarn for textile manufacture requires the use of a lubricant formulation called the "fiber finish" or "spin finish." The spin finish must control the yarn-to-metal friction to protect the newly spun fiber from fusion or breaks and, in the case of texturing, to insure that proper twist is transferred to the yarn. Synthetic fibers must be drawn and textured or bulked to yield optimum physical properties of strength, increased covering, pleasing hand, and greater warmth. During both texturing and bulking, the yarn is exposed to high temperatures. The demand for faster throughput is now requiring temperatures that approach 250° C. thus placing increased stress on the finish to protect the fiber.

It is known to use polyoxyalkylene compounds such as block and heteric polymers of ethylene oxide and propylene oxide as spin finishes for the production of synthetic yarns. Heteric and block polyoxyalkylene compounds particularly from ethylene oxide and propylene oxide derived by polymerization with initiators such as Bisphenol A and tetrahydrofuran are known as spin finishes for the production of synthetic yarns.

The rubber industry is also a major market for such polyoxyalkylene compounds. An important application is for use as a lubricant in the production of tires and rubber hose. In the latter case, it is used as a lubricant to allow easy removal of radiator type hose from the mandrels used to form the hose during vulcanization.

A successful mandrel lubricant must provide good lubricity, be relatively oxidation resistant, produce minimal smoke, either be easily removed from the finished product or not leave a sticky residue, and show a low toxicity. Oxidative stability is important since the lubricant must survive the vulcanization process where the rubber is cured into the hose shape.

The rubber lubricant is often washed off the finished article and then recycled for reuse. Since the rubber hose is reinforced with fibers such as rayon or nylon the lubricant must not form decomposition products that will attack these fibers. Currently acceptable oxidation stability is achieved by heavily stabilizing the polyoxyalkylene glycol with an antioxidant such as phenothiazine. However, this approach suffers from at least three problems, many antioxidants are moderately toxic, they may show only limited solubility in polyoxyalkylene glycol and, finally, they may decompose to strong acids which can hydrolyze the reinforcing fiber.

U.S. Pat. No. 4,094,797 discloses oxidation stable heteric or block copolymer polyoxyalkylene compositions suitable for the treatment of thermoplastic fibers, particularly polyester and nylon fibers, prior to the processing of such fibers. The polyoxyalkylene compounds are derived from lower alkylene oxides and can be initiated with a difunctional aromatic compound containing reactive hydrogens such as dihydroxyphenol and are capped on at least one end of the chain with an alpha-olefin epoxide or mixtures thereof. U.S. Pat. No. 4,134,841 discloses a fiber lubricant composition of enhanced heat stability which comprises a nonhindered polyphenol stabilizer and a polyether lubricant. The 4,4'-*Thiodiphenol Technical Bulletin* published by Crown Zellerbach, Chemical Products Division, Camas, Washington, discloses 4,4'-thiodiphenol which is the initiator for the compound of the instant invention and on page 5 thereof discloses the two mole ethoxylate of 4,4'-thiodiphenol which has the following formula:

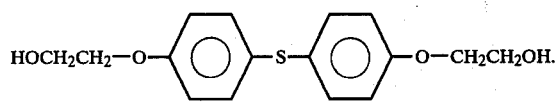

There is no disclosure of any utility for this product.

SUMMARY OF THE INVENTION

In accordance with the instant invention, fiber and rubber lubricants of improved oxidative stability are prepared which comprise a polyoxyalkylene polymer having the generalized formula

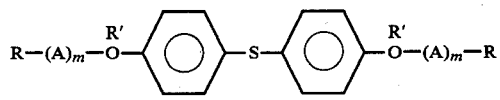

wherein A is an oxyalkylene group selected from oxyethylene, oxypropylene, oxybutylene, oxytetramethylene and heteric and block mixtures thereof; m is a whole number selected to give an overall molecular weight of the product of 400 to 4,000, R is selected from the group consisting of H, $C_1$–$C_{20}$ aliphatic group and $R''\overset{\overset{\displaystyle O}{\|}}{C}$ R' is hydrogen, halogen, an alkyl radical of 1 to 20 carbon atoms, or a carboxyl group and R'' is H or $C_1$ to $C_{20}$ aliphatic group; and wherein R, R' and R'' as appearing in the above formula may each be the same or different; and m in each instance may be the same or different. In a preferred embodiment of the invention, A comprises oxyethylene groups and groups selected from oxypropylene and oxybutylene wherein the oxyethylene groups are attached to the oxygen that is attached to the phenol group and the oxypropylene or oxybutylene groups are attached at the opposite end of the oxyethylene groups.

In another preferred embodiment A comprises oxyethylene groups and groups selected from oxypropylene and oxybutylene groups wherein said oxypropylene or oxybutylene groups are attached to the oxygen that in turn is attached to the phenol groups and the oxyethylene groups are attached at the opposite end of the oxypropylene or oxybutylene groups. The molecular weight of the final product is from about 700 to 12,000. For use as a fiber or rubber lubricant, the above-described polyalkylene oxide polymer may be used alone or in admixture with other fiber or rubber lubricants or with water or conventional solvents.

The compound of the invention is prepared by reacting 4,4'-thiodiphenol with the alkylene oxide, or with a mixture of alkylene oxides where more than one is employed, or sequentially first with one alkylene oxide than the other, such as, for example, reaction first with propylene oxide followed by reaction with ethylene oxide.

DESCRIPTION OF THE PREFERRED EMBODIMENT

Due to its high melting point, the 4,4'-thiodiphenol may be first mixed with a suitable non-reactive solvent. As used herein, the expression "non-reactive solvent" means a solvent characterized by little or no reactivity with the reactants employed in the instant invention. It does not mean that the solvent is completely inert. Suitable non-reactive solvents include: dimethoxyethane, aromatic and aliphatic hydrocarbons such as toluene and heptane, fluorocarbons such as perfluorohexane, and ethers such as diethylene glycol dimethyl ether and polyoxyethylene-polyoxypropylene dimethyl ethers.

The reaction mixture contains by weight from about 20 to 100 percent 4,4'-thiodiphenol, 0 to 80 percent, of, the non-reactive solvent and about 0.01 to 5.0 percent base catalyst. Where a non-reactive solvent is employed, the minimum amount in the reaction mixture is about 10 percent by weight. In a preferred embodiment of the invention the reaction mixture contains by weight about 50 to 75 percent 4,4'-thiodiphenol, 25 to 50 percent non-reactive solvent and about 0.05 to 1.0 percent base catalyst. The mixture is heated to a temperature of from about 100° C. to 200° C. and evaculated to less than 10 millimeters of mercury. After stripping for approximately 30 to 90 minutes, the vacuum is relieved to 0 to 5 psig with nitrogen and the alkylene oxide added over a period of about 5 to 15 hours. The reaction then proceeds until a constant pressure is observed which requires from about 1 to 10 hours. The amount of alkylene oxide, or alkylene oxides as the case may be, ranges from about 12 to 200 moles alkylene oxide per mole of 4,4'-thiodiphenol. The preferred compounds are prepared employing ethylene oxide which may be used alone, or the 4,4'-thiodiphenol may be reacted with either a mixture of ethylene oxide and a $C_3$ to $C_5$ higher alkylene oxide or reacted sequentially with either the higher alkylene oxide followed by the ethylene oxide or vice versa. The ratio of higher alkylene oxide to ethylene oxide ranges from 0 to 90 moles per mole of ethylene oxide and preferably 25 to 75 moles per mole of ethylene oxide.

The following examples further illustrate the various aspects of the invention. Where not otherwise specified throughout this specification and claims, temperatures are indicated in degrees centigrade and parts, percentages and proportions are by weight.

EXAMPLE 1

To a clean, dry autoclave was charged 200.0 parts of 4,4'-thiodiphenol and 9.6 parts of potassium hydroxide and 150 parts dimethoxyethane. After purging with nitrogen and pressure checking, this mixture was heated to 110° C. with agitation. The pressure rises due to the presence of the solvent. Propylene oxide was then added in an amount of about 372.5 parts over a one hour period at a pressure of less than 90 psig. When the pressure rises above 90 psig, propylene oxide addition was stopped and the action allowed to proceed until a lower pressure resulted after which more propylene oxide was added. When the addition was complete, the reaction was continued for an additional hour.

The autoclave was then vented and evacuated to less than 10 millimeters of mercury for 0.5 hour to remove the volatiles and thus stripping out the solvent. The vacuum was then relieved to 0 psig with nitrogen, the temperature raised to 125° C. and a mixture of 1583.3 parts of ethylene oxide and 527.8 parts of propylene oxide added at a rate of 300 to 400 parts per hour and less than 90 psig. The pressure was generally maintained below 90 psig by stopping oxide addition and allowing the reactants to react out until the pressure drops below 90 psig after which further ethylene oxide-propylene oxide mixture was added. When the addition was complete, the reaction was continued for 2 hours. The product was then vented through a trap to remove the volatiles and cooled to 100° C. followed by discharging to a nitrogen-flushed container. The product was then purified with Britesorb®-90 magnesium silicate, filtered and stripped.

The level of oxidative stability of the product of the above example was demonstrated by placing an approximately 3 gram sample on an aluminum plate placed in an oven at about 240° C. for periods of one-half, two, four and 24 hours. After one-half hour, the residue weighed about 98.3 percent of the starting weight; after two hours, it weighed 88.7 percent; after four hours, 78.3 percent; even after 24 hours, it weighed 28.3 percent of the starting weight. This clearly demonstrates the oxidative stability of the product of the instant invention.

EXAMPLE 2

A polyamide polymer is fed into a screw extruder and heated to 290° C. The molten polymer is pumped under pressure of approximately 1000 psig through the capillary of a spinnerette plate. Freshly extruded filaments are put through a descending spinning tower into which air of 70° F. temperature and 65 percent relative humidity is admitted. The filaments are gathered into yarn and upon emerging from the spinning tower are coated with the fiber lubricant solution comprising 25 percent by weight of the product of Example 1 and 75 percent of water. The lubricant coating is applied to the yarn at a rate of 0.75 weight percent based on the weight of the yarn. The yarn is then wound into a package at a rate of about 2000 feet per minute. The resulting yarn is then drawn over a 0.5 inch diameter draw pin at a delivery rate of 1,536 feet per minute during which time the yarn passes over a heater maintained at 175° C.

EXAMPLE 3

This example illustrates the use of the compound of the instant invention in the molding of rubber.

Water is added to the compound prepared in accordance with Example 1 until a concentration of 37 percent of the compound of Example 1, balance water is obtained. Natural rubber in a green or uncured stage is molded around a metal form in the form of an automobile radiator hose by first dumping a scoop of the previously diluted mold release composition onto a metal mandrel or form for molding a hose. The rubber is next applied around the metal mold together with several layers of rayon fabric reinforcement. The assembly is then placed in an autoclave in which it is heated to a temperature of 200° C. and is maintained at this temperature for a period of about 10 minutes in order to cure the rubber hose composition.

The embodiments of the invention in which an exclusive privilege or property is claimed are defined as follows:

1. A process for preparing a polyoxyalkylene compound comprising reacting 4,4'-thiodiphenol with at least one alkylene oxide in the presence of a base catalyst.

2. The process of claim 1 wherein the amount of said alkylene oxide is sufficient to give a final product having a molecular weight of from about 700 to 12,000.

3. The process of claim 2 wherein a mixture of the 4,4'-thiodiphenol and the base catalyst is heated in a container at about 100° C. to 200° C., said container is evaculated to less than 10 millimeters of mercury, the vacuum is relieved to about 0 to 5 psig and the alkylene oxide added over a period of about 5 to 15 hours followed by reaction for about 1 to 10 hours, the catalyst neutralized and the product stripped to remove volatiles.

4. The process of claim 3 wherein first a mixture of 4,4'-thiodiphenol, base catalyst and a solvent is heated followed by said alkylene oxide addition.

5. The process of claim 2 wherein said alkylene oxide is selected from the group consisting of ethylene oxide, propylene oxide, butylene oxide and mixtures thereof.

6. The process of claim 5 wherein said catalyst is potassium hydroxide.

7. The process of claim 5 wherein ethylene oxide and an alkylene oxide selected from the group consisting of propylene oxide and butylene oxide are sequentially reacted with the 4,4'-thiodiphenol.

8. The process of claim 7 wherein said alkylene oxide selected from propylene oxide and butylene oxide is propylene oxide.

9. The process of claim 7 wherein the alkylene oxide selected from the group consisting of propylene oxide and butylene oxide is first reacted with the 4,4'-thiodiphenol followed by reaction with the ethylene oxide.

10. The process of claim 7 wherein the 4,4'-thiodiphenol is first reacted with the ethylene oxide followed by reaction with the alkylene oxide selected from the group consisting of propylene oxide and butylene oxide.

11. A polyoxyalkylene compound having the formula:

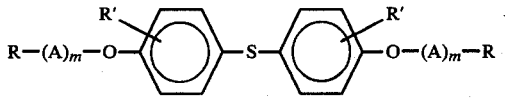

wherein A is selected from the group consisting of oxyethylene, oxypropylene, oxybutylene, oxytetramethylene and heteric or block mixtures thereof, m is a whole number selected to given an overall molecular weight of 400 to 4000, R is selected from the group consisting of H, $C_1$ to $C_{20}$ aliphatic groups and

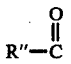

wherein R' is H, halogen, an alkyl radical of 1 to 20 carbon atoms or a carboxyl groups and R'' is H or a $C_1$ to $C_{20}$ aliphatic group and wherein R, R' and R'' may each be the same or different and m in each instance may be the same or different.

12. The compound of claim 11 wherein A is a heteric mixture of oxyethylene groups and groups selected from oxypropylene and oxybutylene.

13. The compound of claim 11 wherein A comprises oxyethylene groups and groups selected from oxypropylene and oxybutylene wherein the oxyethylene groups are attached to the oxygen that is attached to the phenol group and the oxypropylene or oxybutylene groups are attached at the opposite end of the oxyethylene groups.

14. The compound of claim 11 wherein A comprises oxyethylene groups and groups selected from oxypropylene and oxybutylene groups wherein said oxypropylene or oxybutylene groups are attached to the oxygen that in turn is attached to the phenol groups and the oxyethylene groups are attached at the opposite end of the oxypropylene or oxybutylene groups.

15. The compound of claim 11 wherein A comprises oxyethylene and oxypropylene groups.

16. A process of lubricating synthetic fibers which comprises applying to the fiber, in an amount of from about 0.05 weight percent to 5 weight percent, based on the weight of the lubricated fiber, of the polyoxyalkylene lubricant of claim 11.

17. The process of lubricating rubber forms which comprises applying to the rubber form an amount of from about 0.1 to 10 weight percent, based on the weight of the lubricated rubber, of the polyoxyalkylene lubricant of claim 11.

* * * * *